US011596828B1

(12) United States Patent
Koscielski et al.

(10) Patent No.: US 11,596,828 B1
(45) Date of Patent: Mar. 7, 2023

(54) GAIT TRAINER ATTACHMENT

(71) Applicant: Enlighten Mobility, LLC, South Bend, IN (US)

(72) Inventors: Marissa Koscielski, Columbus, OH (US); Adrian Rodriguez, South Bend, IN (US); Theresa Rogers, Silver Spring, MD (US)

( * ) Notice: Subject to any disclaimer, the term of this patent is extended or adjusted under 35 U.S.C. 154(b) by 259 days.

(21) Appl. No.: 17/073,528

(22) Filed: Oct. 19, 2020

Related U.S. Application Data

(60) Provisional application No. 62/916,866, filed on Oct. 18, 2019.

(51) Int. Cl.
*A63B 22/00* (2006.01)
*A63B 22/02* (2006.01)
(Continued)

(52) U.S. Cl.
CPC .... *A63B 22/0046* (2013.01); *A63B 21/00178* (2013.01); *A63B 21/00181* (2013.01);
(Continued)

(58) Field of Classification Search
CPC ... A63B 23/08; A63B 23/085; A63B 23/0429; A63B 23/0482; A63B 23/0494; A63B 23/0423; A63B 23/0417; A63B 23/0405; A63B 23/04; A63B 23/03541; A63B 23/03508; A63B 23/03533; A63B 22/0285; A63B 22/0292; A63B 22/0235; A63B 22/0242; A63B 22/025; A63B 22/0257; A63B 22/0264; A63B 22/0214; A63B 22/0221; A63B 22/0228; A63B 22/0207; A63B 22/0025; A63B 22/00; A63B 22/0007; A63B 21/00181; A63B 21/00178; A63B 21/4011; A63B 21/4013;
(Continued)

(56) References Cited

U.S. PATENT DOCUMENTS 4,697,808 A 10/1987 Larson et al.
5,000,440 A * 3/1991 Lynch ..... A63B 22/0012 482/130

(Continued)

FOREIGN PATENT DOCUMENTS

CN 106334265 1/2017
EP 2907495 8/2015

(Continued)

*Primary Examiner* — Megan Anderson
*Assistant Examiner* — Thao N Do

(57) ABSTRACT

A gait trainer attachment adapted for use with exercise equipment and a method for using the gait trainer attachment. Embodiments of the gait trainer attachment include a frame, a leg brace, and a compromised limb gait system. The compromised limb gait system attaches the leg brace to the frame and is configured to guide a limb of a user through a simulated gait motion. In aspects, the gait trainer attachment gives an amputee user the ability to use ordinary exercise equipment for rehabilitation and endurance training by providing a leg brace for the compromised limb, a frame designed to attach to exercise equipment, and a connection between the leg brace and frame that guides the compromised limb, thus allowing the user to maintain a biomechanically proper walking motion while exercising.

16 Claims, 18 Drawing Sheets

(51) Int. Cl.
*A63B 23/04* (2006.01)
*A63B 21/00* (2006.01)

(52) U.S. Cl.
CPC ..... *A63B 22/02* (2013.01); *A63B 23/04* (2013.01); *A63B 2022/0094* (2013.01)

(58) Field of Classification Search
CPC ..... A63B 21/4015; A63B 2022/0043; A63B 2022/0033; A63B 2022/0035; A63B 2022/0094; A63B 69/0057; A63B 69/0059; A63B 69/0062; A61H 3/00; A61H 3/024; A61H 3/0237
USPC ..... 482/54
See application file for complete search history.

(56) References Cited

U.S. PATENT DOCUMENTS 5,502,851 A * 4/1996 Costello ..... A61H 3/04 5/89.1
5,588,456 A 12/1996 Hart
5,662,560 A * 9/1997 Svendsen ..... A63B 71/0009 482/54
5,702,326 A 12/1997 Renteria
5,728,164 A 3/1998 Ferrari et al.
5,766,236 A 6/1998 Detty et al.
6,343,802 B1 2/2002 Workman et al.
6,520,891 B1 * 2/2003 Stephens, Jr. ..... A63B 23/047 482/121
6,607,202 B1 8/2003 Palmer
6,645,126 B1 11/2003 Martin et al.
6,652,427 B2 11/2003 Wroclawsky
6,832,770 B1 12/2004 Wright-Ott et al.
7,150,722 B1 12/2006 Tyrell
7,422,550 B1 9/2008 Pinero et al.
8,905,951 B2 12/2014 Barriskill et al.
9,044,630 B1 * 6/2015 Lampert ..... A63B 21/4033
9,370,680 B1 * 6/2016 Macaulay ..... A63B 71/023
9,415,205 B2 8/2016 Lasko et al.
9,474,928 B1 * 10/2016 Maresh ..... A63B 22/02
9,616,282 B2 4/2017 Tholkes et al.
9,649,243 B2 5/2017 Johnson et al.
9,662,526 B2 5/2017 Agrawal et al.
10,076,656 B2 9/2018 Dar et al.
10,376,734 B1 * 8/2019 Razon ..... A61B 5/0077
10,406,059 B2 9/2019 Agrawal et al.
10,493,309 B2 * 12/2019 Jue ..... A63B 21/00069
10,493,315 B2 * 12/2019 Rubin ..... A63B 21/4033
10,561,894 B2 * 2/2020 Dalebout ..... A63B 22/0235
10,729,604 B2 * 8/2020 Tsusaka ..... A61G 7/1017
10,870,198 B1 12/2020 Asbeck et al.
11,259,982 B2 * 3/2022 Ognibene ..... A63B 21/065
11,291,600 B2 * 4/2022 Van Raemdonck ..... A61G 7/1049
2002/0010056 A1 * 1/2002 Borsheim ..... A61H 3/00 482/54
2003/0093021 A1 5/2003 Goffer
2004/0023759 A1 2/2004 Duncan et al.
2004/0242347 A1 * 12/2004 Langhorn ..... A63B 63/00 473/402
2006/0128537 A1 * 6/2006 Philips ..... A61H 1/0266 482/148
2010/0170546 A1 7/2010 Popovic et al.
2010/0285929 A1 * 11/2010 Bayerlein ..... A61H 1/024 482/54
2011/0082013 A1 * 4/2011 Bastian ..... A63B 21/4035 482/54
2012/0000496 A1 1/2012 Razon
2013/0005541 A1 * 1/2013 Robinson ..... A63B 22/02 482/54
2014/0087922 A1 * 3/2014 Bayerlein ..... A63B 21/00181 482/54
2014/0213951 A1 * 7/2014 Pietrusisnki ..... A61H 3/008 602/23
2014/0228186 A1 * 8/2014 Montgomery ..... A63B 23/0494 482/139
2015/0075575 A1 3/2015 Karlovich
2015/0080187 A1 * 3/2015 Beane ..... A63B 69/0064 482/51
2015/0087484 A1 * 3/2015 Bayerlein ..... A63B 69/0064 482/54
2015/0351995 A1 12/2015 Zoss et al.
2016/0001118 A1 * 1/2016 Kuehne ..... A63B 23/04 482/54
2016/0089563 A1 * 3/2016 Dilli ..... A63B 22/00 482/54
2016/0166454 A1 6/2016 Johnson et al.
2016/0310731 A1 * 10/2016 Dixon ..... A61H 1/024
2016/0331626 A1 11/2016 Fellingham et al.
2017/0136295 A1 * 5/2017 Tholkes ..... A61B 5/4566
2018/0330647 A1 * 11/2018 Sipek ..... A44B 1/04
2018/0330817 A1 11/2018 Avni et al.
2019/0015273 A1 1/2019 Linon
2019/0046828 A1 * 2/2019 Kuehne ..... A63B 22/02
2019/0054335 A1 * 2/2019 Yeh ..... A63B 21/068
2019/0060154 A1 2/2019 Lee et al.
2019/0083843 A1 * 3/2019 Del Monaco ..... A63B 22/0089
2019/0099315 A1 4/2019 Kuehne et al.
2019/0183719 A1 * 6/2019 Koscielski ..... A61H 3/04
2019/0216674 A1 7/2019 Maggu et al.
2019/0231632 A1 8/2019 Hoekelmann et al.
2019/0282431 A1 9/2019 Moore
2020/0222754 A1 * 7/2020 Walker ..... A63B 23/025

FOREIGN PATENT DOCUMENTS

GB 2484463 4/2012
RU 157028 11/2015
WO WO2006118756 9/2006
WO WO2014001853 3/2014
WO WO2014177206 11/2014

* cited by examiner

GAIT TRAINER ATTACHMENT

CROSS-REFERENCE TO RELATED APPLICATIONS

This application claims the benefit of the filing date of U.S. provisional patent application Ser. No. 62/916,866, filed on Oct. 18, 2019, entitled "Rehabilitative Gait Trainer with Brace Interface for Use on a Treadmill" which is incorporated herein by reference in its entirety.

BACKGROUND

Physical therapy and rehabilitation are long and difficult processes for patients with compromised limbs or unilateral immobility. Following surgery, amputation patients frequently do not receive adequate healthcare resources to meet their rehabilitation needs. Patients who have had a portion of one of their legs amputated wait, at a minimum, six to eight weeks for a prosthetic limb to be fabricated, and often the time required for the limb to heal and the prosthetic to be fabricated is much longer than that. During this waiting period, the vast majority of patients rely exclusively on wheelchairs for mobility and have limited options for rehabilitative exercise. Similarly, patients with full or partial paralysis of a lower limb, or other conditions that result in a compromised lower limb, may be confined to a wheelchair during recovery and experience only limited rehabilitation or exercise. For weeks, patients are substantially wheelchair-bound and limited to physical therapy sessions for rehabilitation.

This limited mobility of the lower limbs can lead to irreversible physiological breakdowns with severe consequences, such as muscle atrophy, joint contractures, phantom limb syndrome, and acceleration of peripheral artery disease. Additionally, in cases where amputation was required because of a patient's vascular disease, the immobility can accelerate the vascular disease in the remaining, non-amputated limb leading to additional medical treatment. Even where a patient might initially have adequate rehabilitation resources, it is all too common for patients that experience an illness or injury, such as a stroke or amputation, to undergo inpatient rehabilitation for a brief period. Upon returning to their own home, those patients experience a rapid decline because they do not have assistive technology for locomotor training.

Generally, before a prosthetic device can be fabricated, amputation patients are confined to the time and location of their physical therapy sessions for rehabilitation and exercise. Similarly, patients with monoplegia or stroke victims often struggle with limited opportunities for rehabilitation or exercise. While conventional gait training devices assist in guiding the compromised limb of a user through a simulated gait motion, they are not particularly well-suited for use outside of physical therapy sessions or for endurance training because they are cumbersome, prohibitively expensive, and incompatible with common exercise equipment. As a result, amputee or monoplegic patients may find it difficult or impossible to use traditional gait training devices outside of physical therapy sessions or for extended duration endurance training.

BRIEF SUMMARY

The following presents a simplified summary in order to provide a basic understanding of some aspects of the claimed subject matter. This summary is not an extensive overview. It is not intended to either identify key or critical elements or to delineate the scope of the claimed subject matter. Its sole purpose is to present some concepts in a simplified form as a prelude to the more detailed description that is presented later.

The described apparatuses and methods relate to medical devices and more particularly to gait trainers for those with compromised mobility. The gait trainer attachment described herein, in aspects, gives a patient or user the ability to train with common exercise equipment by providing a leg brace and swing arm that guides the compromised limb through a biomechanically proper walking motion. The swing arm is connected to a frame that is designed to attach to exercise equipment, thus allowing the patient to maintain proper biomechanics when using the exercise equipment. In aspects, the described gait trainer attachment facilitates the biomechanics of a normal gait motion, including the muscle activations in the gait cycle, when exercising. For an amputee patient or a user with an otherwise compromised limb, embodiments of the gait trainer attachment allow the compromised limb to bear weight, encourage activation of muscles in the compromised limb, and allow the patient to exercise in a normal gait pattern with proper biomechanics. This prevents disease processes from accelerating, reduces pain, and strengthens the bones and muscles in the compromised limb. In addition, embodiments of the described gait trainer attachment can be portable and the frame adjustable, allowing patients to exercise using the gait trainer attachment outside of the time and location constraints of physical therapy sessions. In embodiments, the compact design allows the gait training device to be used in a variety of settings including but not limited to, physical therapy, hospitals, clinics, gyms, and the home. The adjustable design allows the gait training device to be used with different types of exercise equipment including, but not limited to, treadmills, ellipticals, and stair steppers. Further, the gait training device can be particularly beneficial when used later in the recovery period or in combination with traditional gait trainers. Traditional gait training devices alone tend not to satisfy the rehabilitative needs of partially recovered patients or users with only partially affected ambulation. A return to normal exercise as quickly as possible can benefit the patient's attitude toward recovery and physical therapy, as well as the strengthening of the muscles and bones of the patient.

In embodiments, the gait trainer attachment includes an adjustable frame that removable attaches to a plurality of exercise equipment, a leg brace configured to hold a compromised limb of a user, and a compromised limb gait system connecting the leg brace to the frame and configured to guide the compromised limb through a simulated gait motion. The compromised limb gait system includes a yoke that connects the leg brace to a swing arm, where the brace is connected to the compromised limb of the user and the swing arm permits movement in substantially a single plane.

To the accomplishment of the foregoing and related ends, certain illustrative aspects of the claimed subject matter are described herein in connection with the following description and the annexed drawings. These aspects are indicative of various ways in which the subject matter may be practiced, all of which are intended to be within the scope of the claimed subject matter. Other advantages and novel features may become apparent from the following detailed description when considered in conjunction with the drawings.

BRIEF DESCRIPTION OF THE FIGURES

The apparatuses, devices, and methods may be better understood by referring to the following description in conjunction with the accompanying drawings, in which like numerals indicate like structural elements and features in various figures. The components in the figures are not necessarily to scale, and simply illustrate the principles of the apparatuses, devices and methods. The accompanying drawings illustrate only possible embodiments of the apparatuses, devices and methods and are therefore not to be considered limiting in scope.

DESCRIPTION

Figure 1:
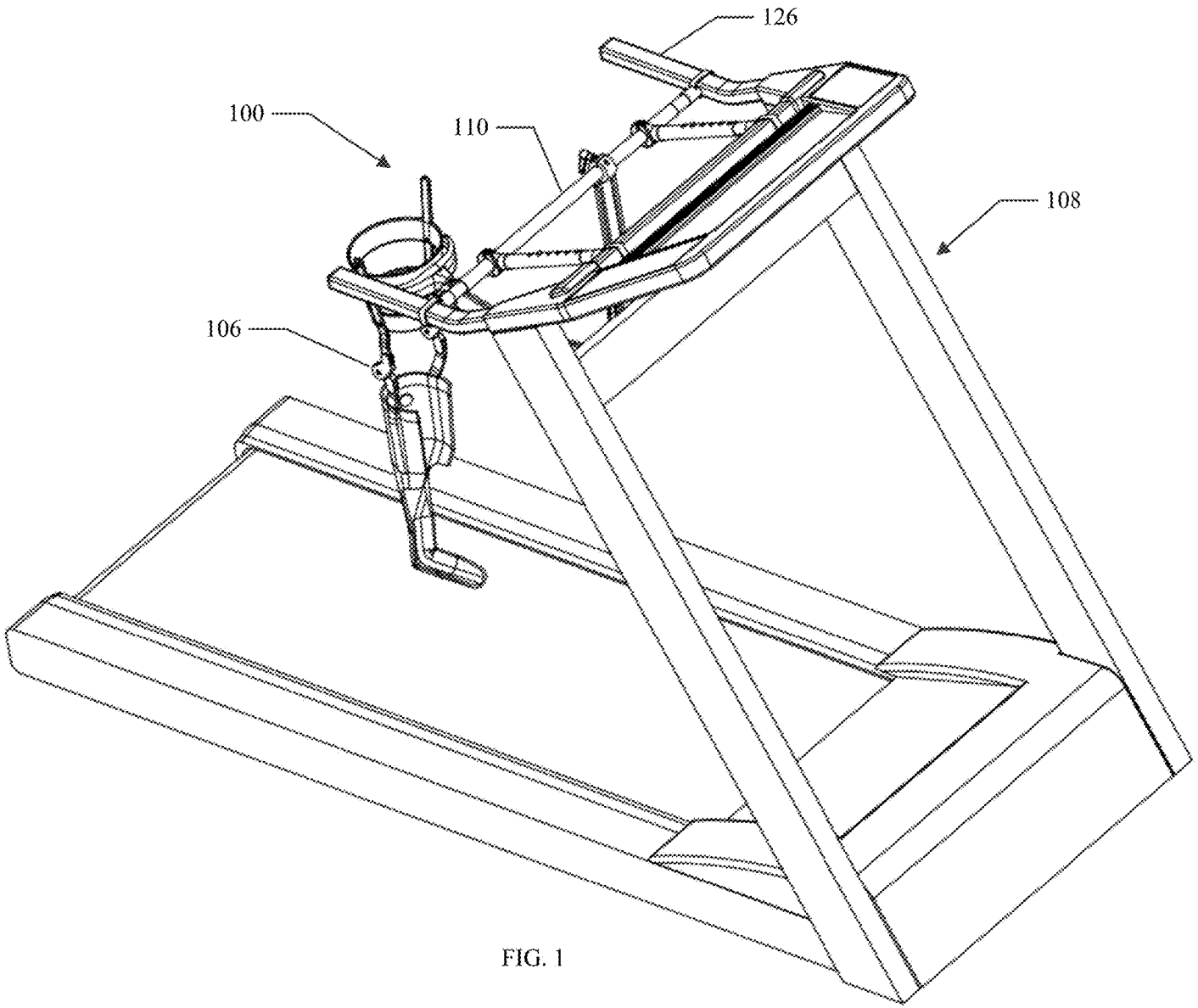
FIG. 1 is a perspective view of an embodiment of a gait trainer attachment attached to a treadmill.

Aspects of the system and methods are described below with reference to illustrative embodiments. The references to illustrative embodiments below are not made to limit the scope of the claimed subject matter. Instead, illustrative embodiments are used to aid in the description of various aspects of the device. The description, made by way of example and reference to illustrative reference, is not meant to be limiting as regards any aspect of the claimed subject matter.

The described devices relate to medical or therapeutic devices and more particularly to gait training devices for those with compromised mobility. The terms "gait training device" and "gait trainer" are used interchangeably herein. In aspects, the described gait trainer attachment facilitates the biomechanics of a normal gait motion, including the typical muscle activations in the gait cycle. For an amputee patient or a user with an otherwise compromised limb, embodiments of the gait trainer attachment guide the user to maintain proper biomechanics when using common exercise or rehabilitation equipment. All of this allows the patient to put weight on the compromised limb, activate muscles in the compromised limb, and walk or run with a normal gait pattern. This prevents disease processes from accelerating, reduces pain, and further strengthens the bones and muscles in the compromised limb. In addition, embodiments of the described gait trainer attachment can be portable, allowing the patient to exercise outside of the time and location constraints of physical therapy sessions. The compact and adjustable design allows the gait trainer attachment to be used in a variety of settings including, but not limited to, physical therapy, hospitals, clinics, gyms, and the home. Further, the gait trainer attachment can be particularly beneficial when used later in the recovery period where patients tend to exhibit more advanced ambulatory ability. The gait trainer attachment, in combination with ordinary exercise equipment, permits the patient to exercise and regain strength independently without requiring medical supervision or special equipment. In addition to strengthening the muscles and bones in the compromised limb and improving the overall health of the patient, a return to normal exercise as quickly as possible can benefit the patient's attitude toward recovery and physical therapy.

While conventional gait trainers provide patients with some options for rehabilitative exercise, they are not well-suited for use outside of physical therapy sessions or for endurance training because they can be cumbersome, prohibitively expensive, and incompatible with common exercise equipment. Thus, amputee, monoplegic, or other patients with reduced mobility may find it difficult or impossible to use traditional gait training devices outside of physical therapy or to use them for prolonged periods of time, such as for endurance training. Other more accessible or portable means for gait training, such as gait training walkers, may be impractical for rehabilitative endurance training because they are not designed for use with pre-existing exercise equipment used in endurance training and can limited in use by surface conditions (e.g. uneven or nonexistent sidewalks) and available space. The gait trainer attachment described herein, in aspects, gives an amputee patient the ability to use common exercise equipment for rehabilitation and endurance training by providing a compromised limb gait system that guides the compromised limb through a biomechanically proper gait motion connected to a frame designed to attach to the exercise equipment.

General Overview

Figure 2:
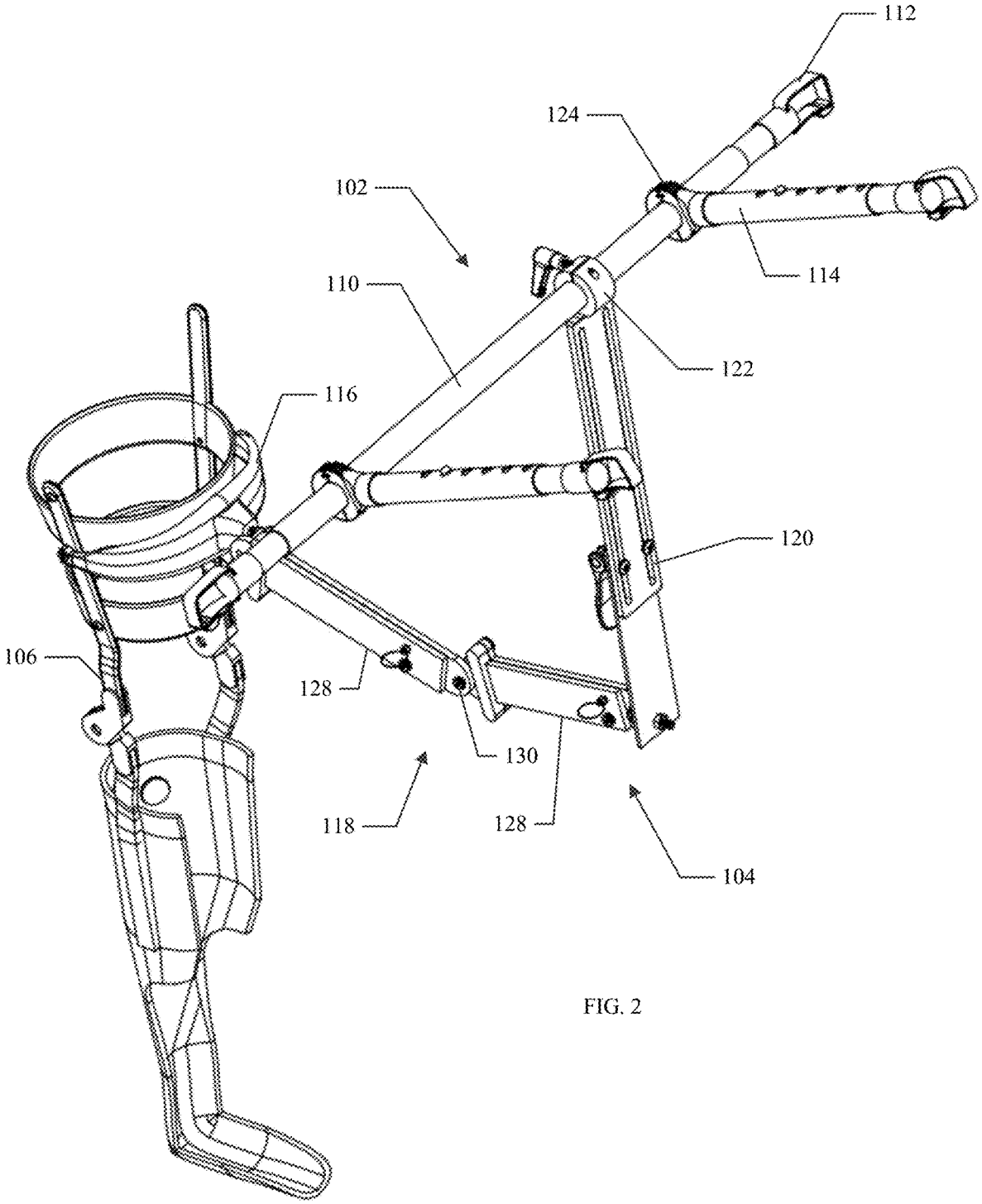
FIG. 2 is a perspective view of the embodiment of the gait trainer attachment of FIG. 1.
Figure 3:
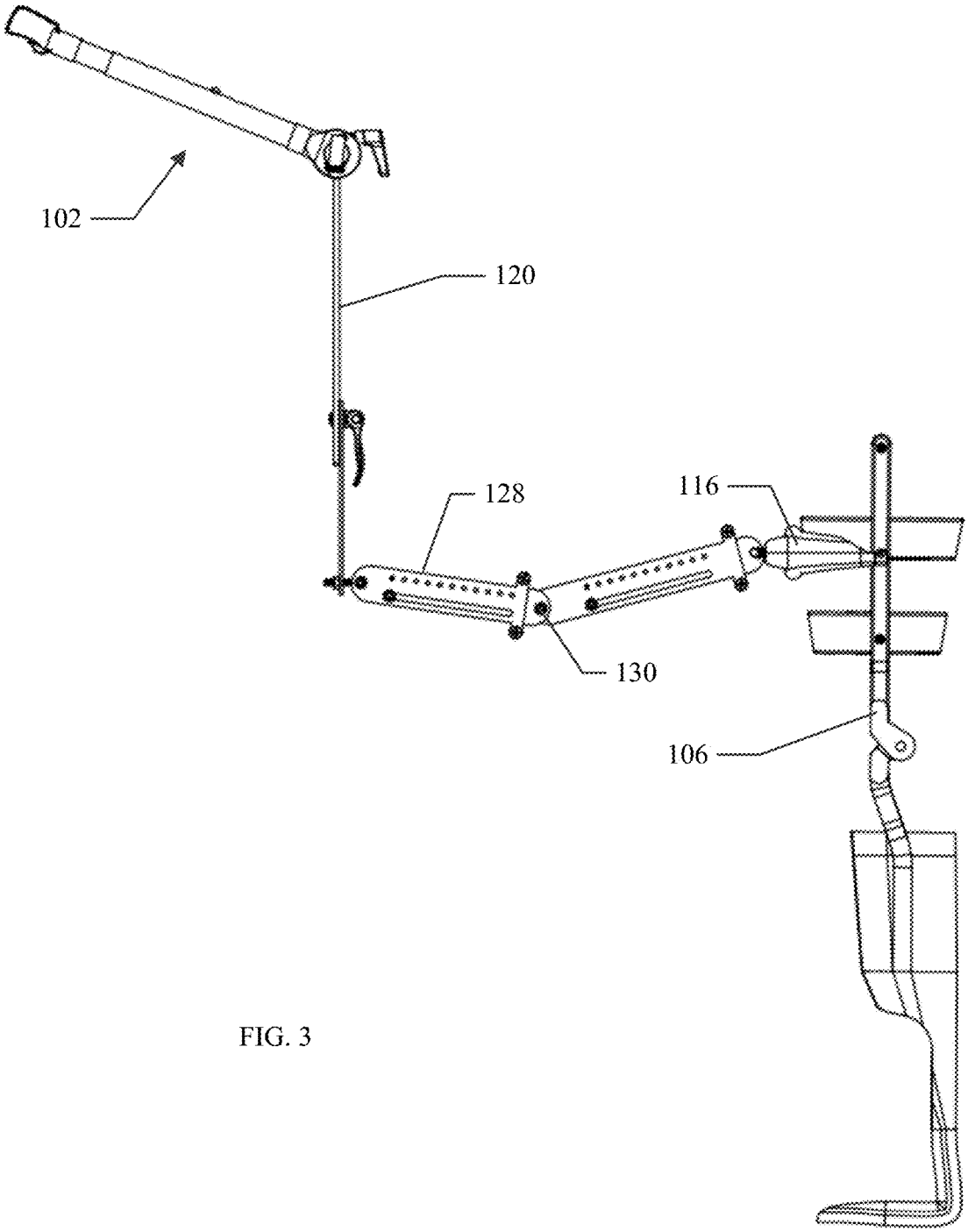
FIG. 3 is a left side view of the embodiment of the gait trainer attachment of FIG. 1.
Figure 4:
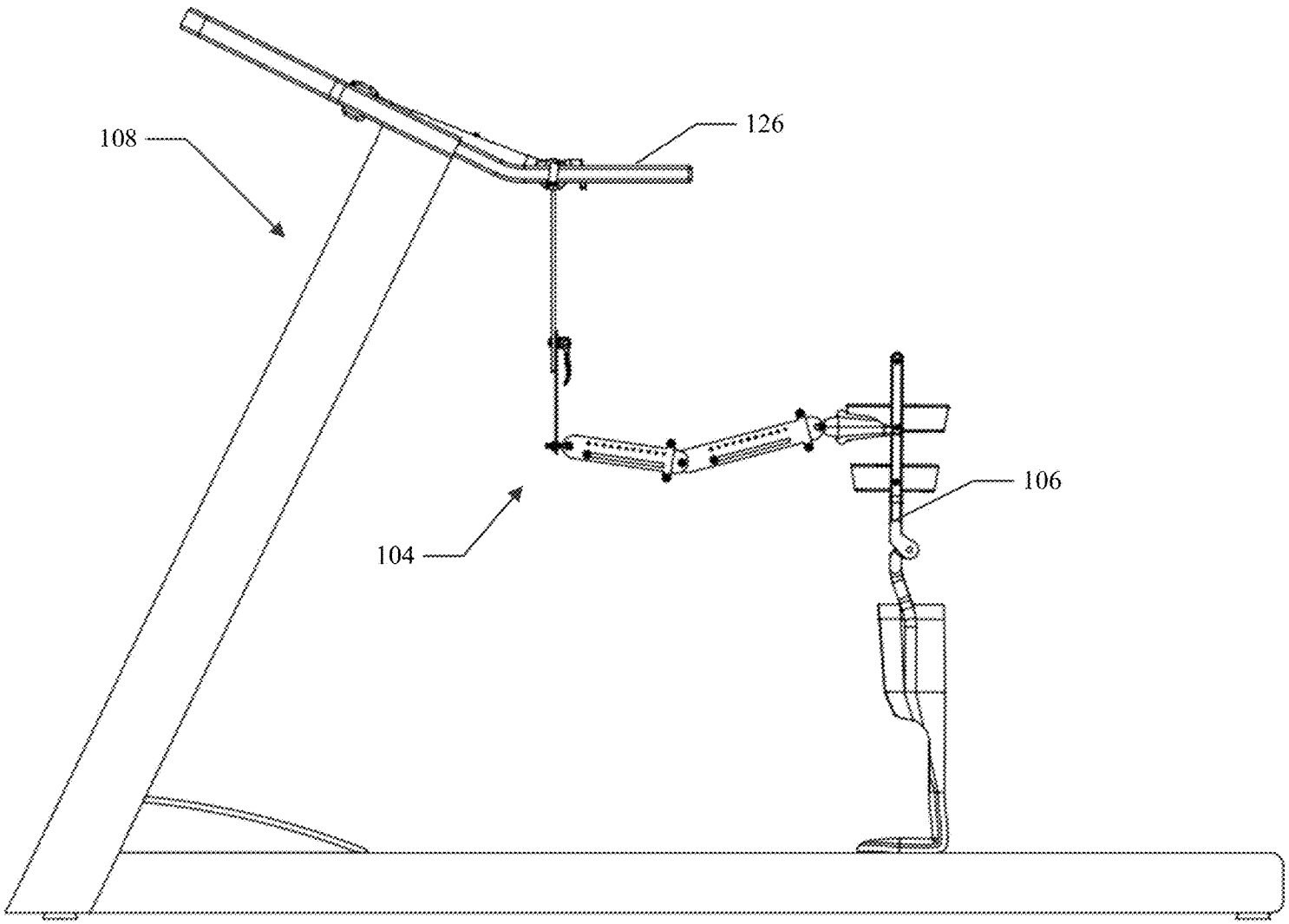
FIG. 4 is a left side view of the embodiment of the gait trainer attachment of FIG. 1 attached to a treadmill.
Figure 5:
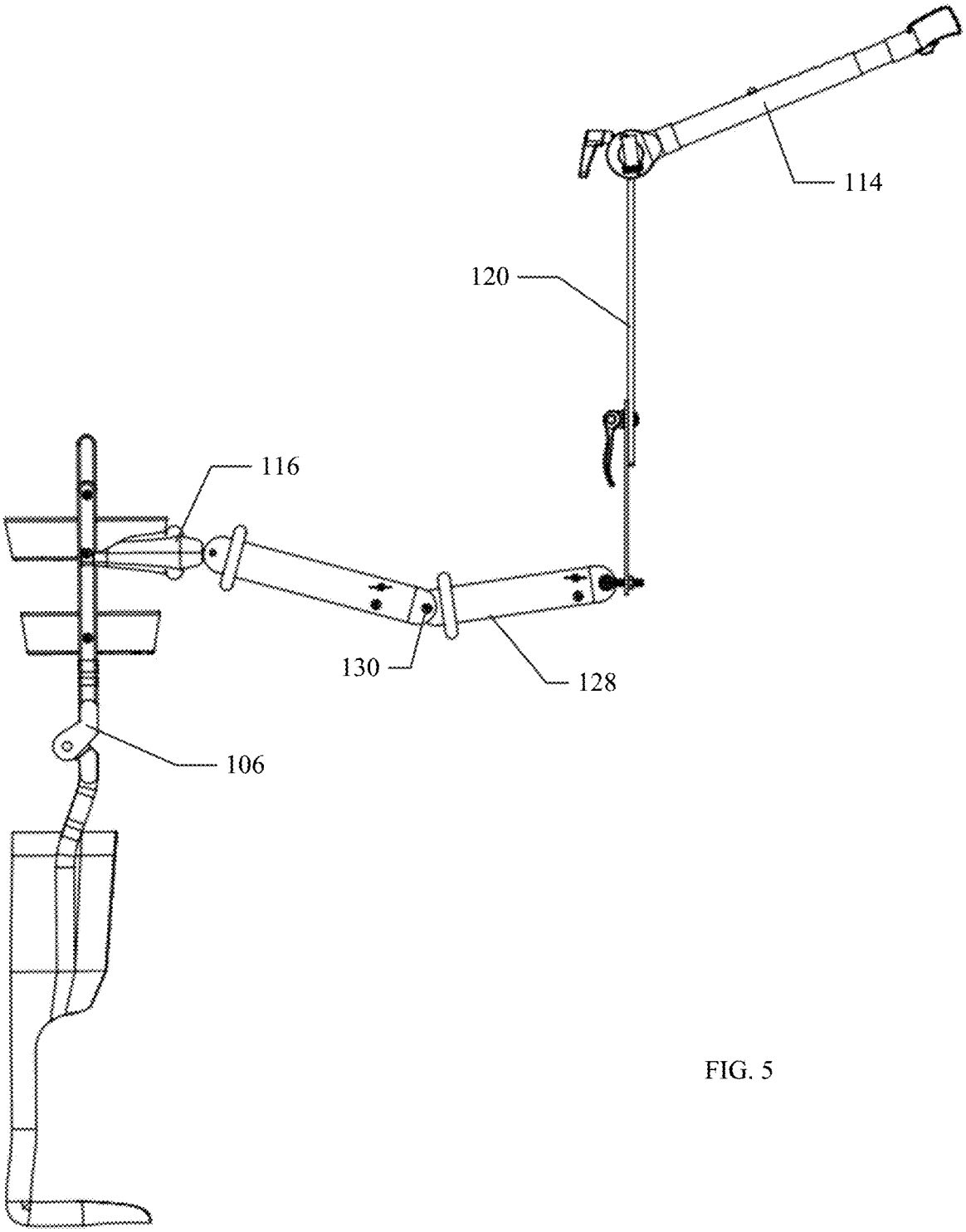
FIG. 5 is a right side view of the embodiment of the gait trainer attachment of FIG. 1.
Figure 6:
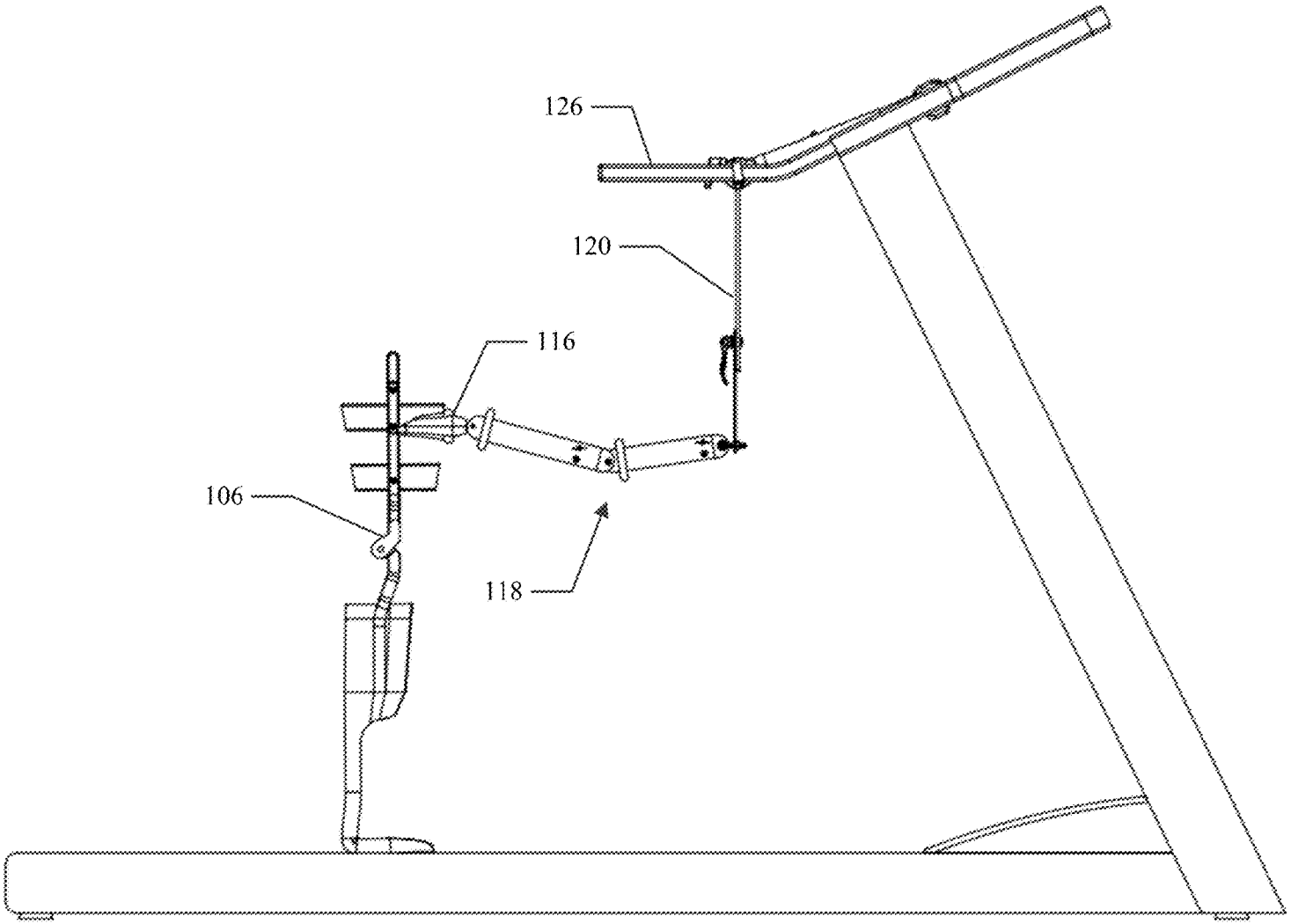
FIG. 6 is a right side view of the embodiment of the gait trainer attachment of FIG. 1 attached to a treadmill.
Figure 7:
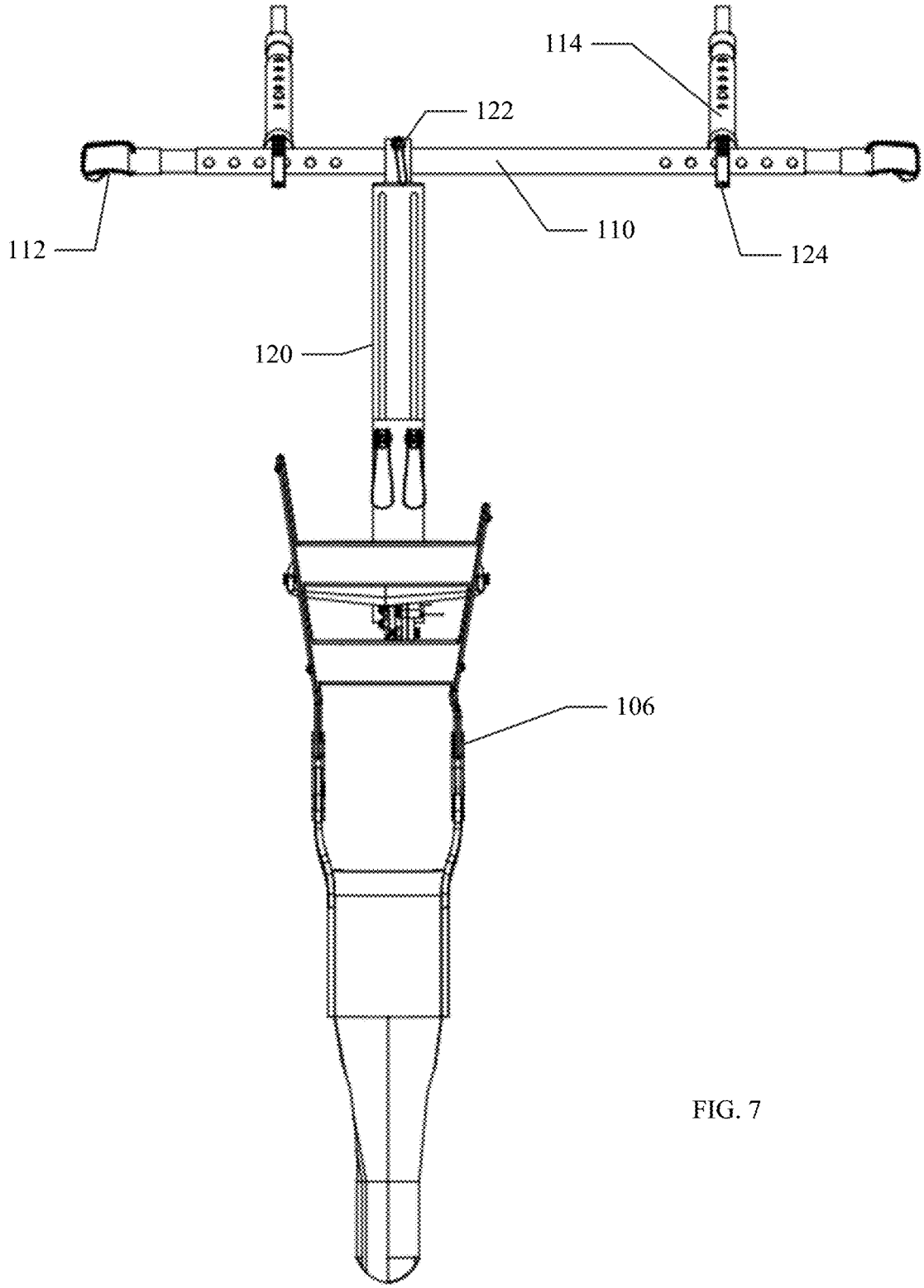
FIG. 7 is a rear view of the embodiment of the gait trainer attachment of FIG. 1.
Figure 8:
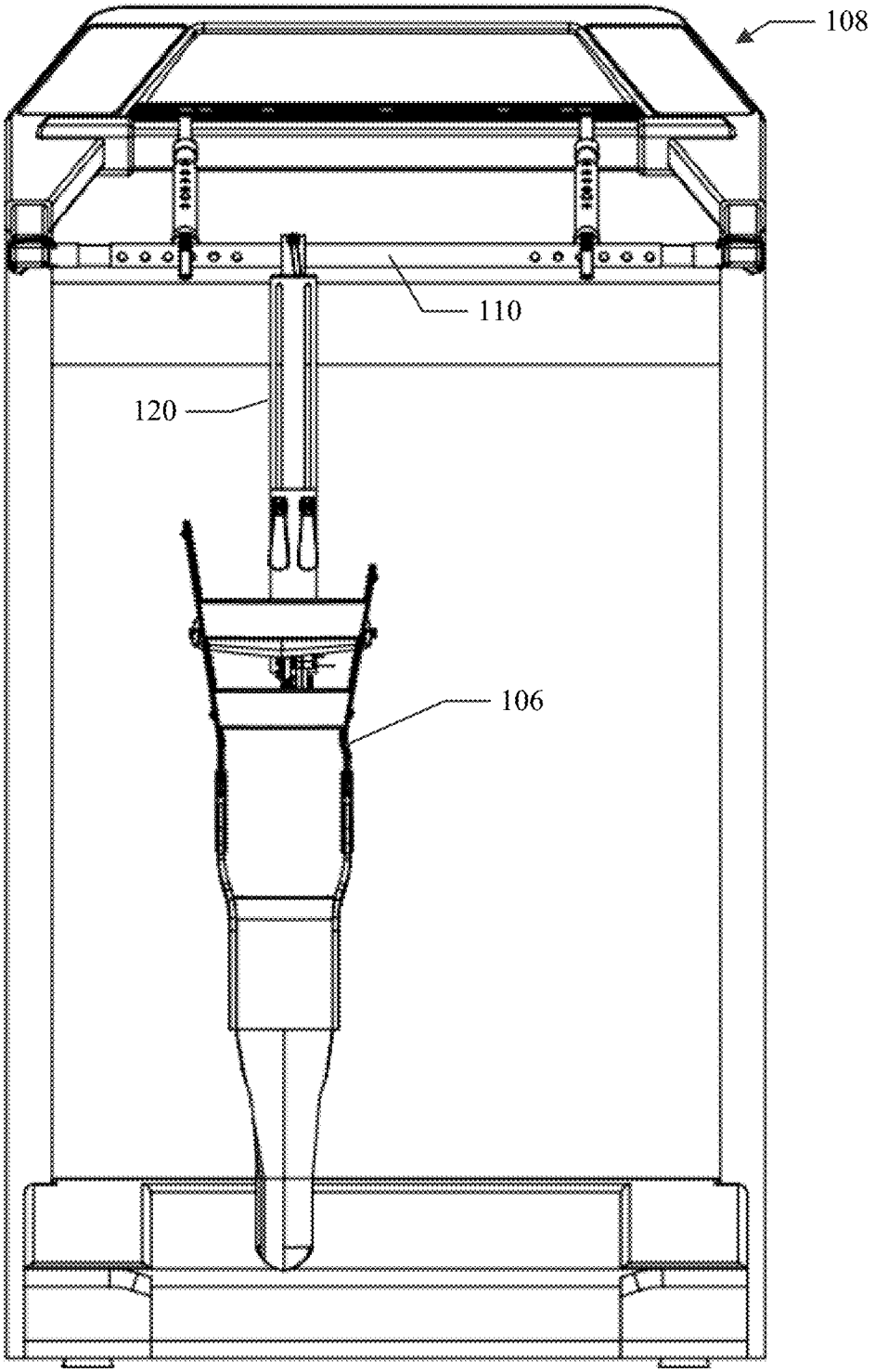
FIG. 8 is a rear view of the embodiment of the gait trainer attachment of FIG. 1 attached to a treadmill.
Figure 9:
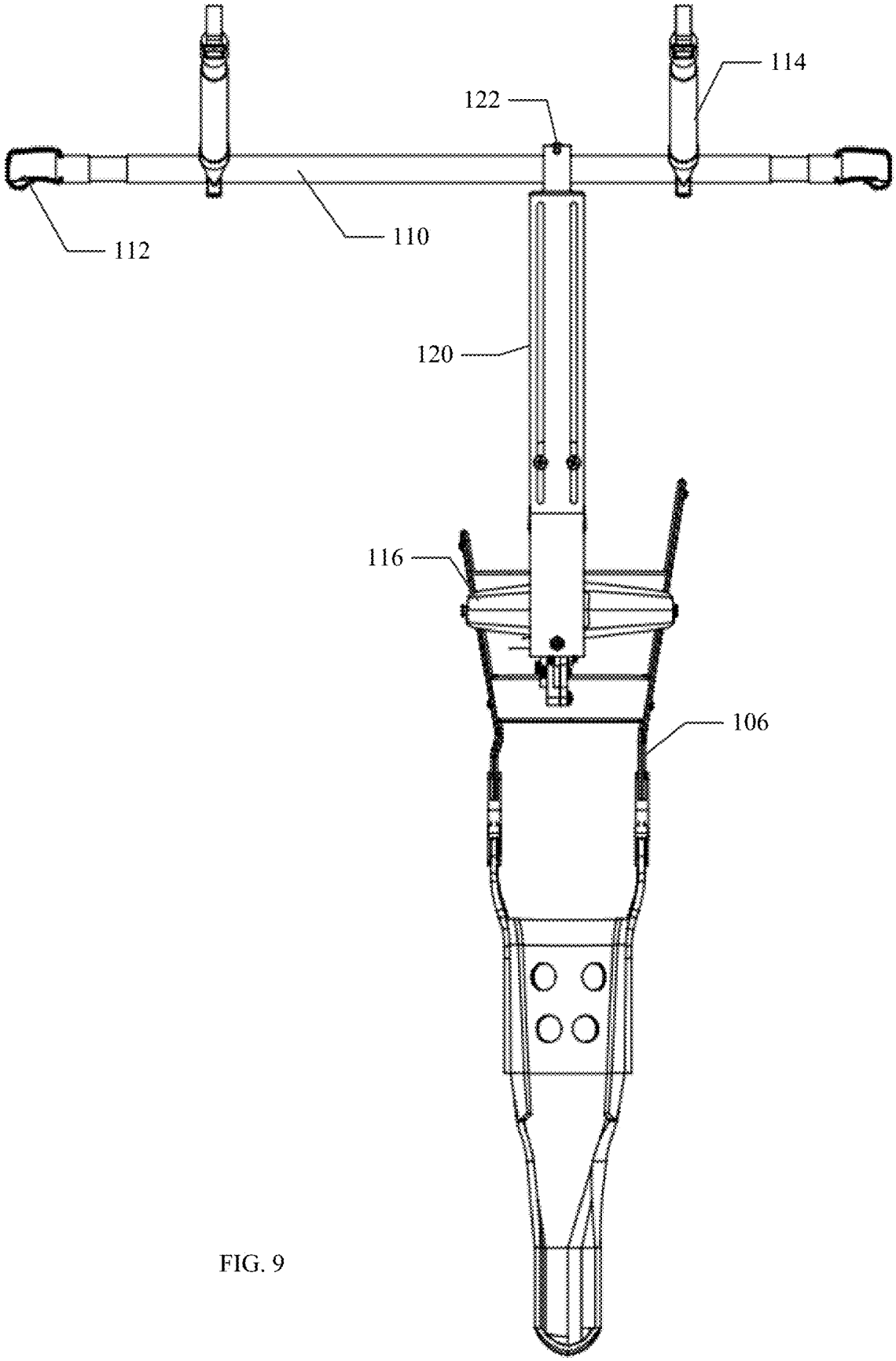
FIG. 9 is a front view of the embodiment of the gait trainer attachment of FIG. 1.
Figure 10:
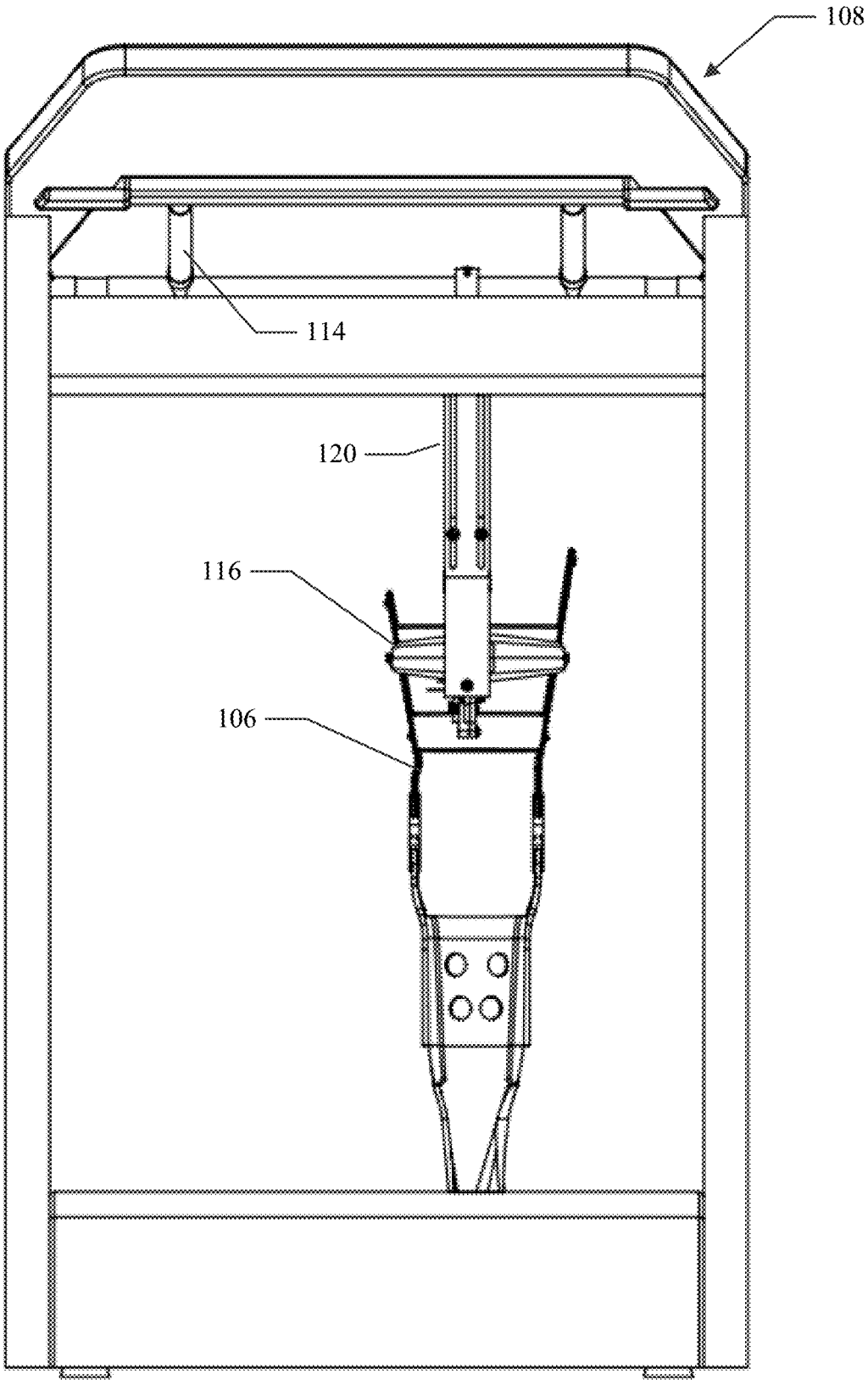
FIG. 10 is a front view of the embodiment of the gait trainer attachment of FIG. 1 attached to a treadmill.
Figure 11:
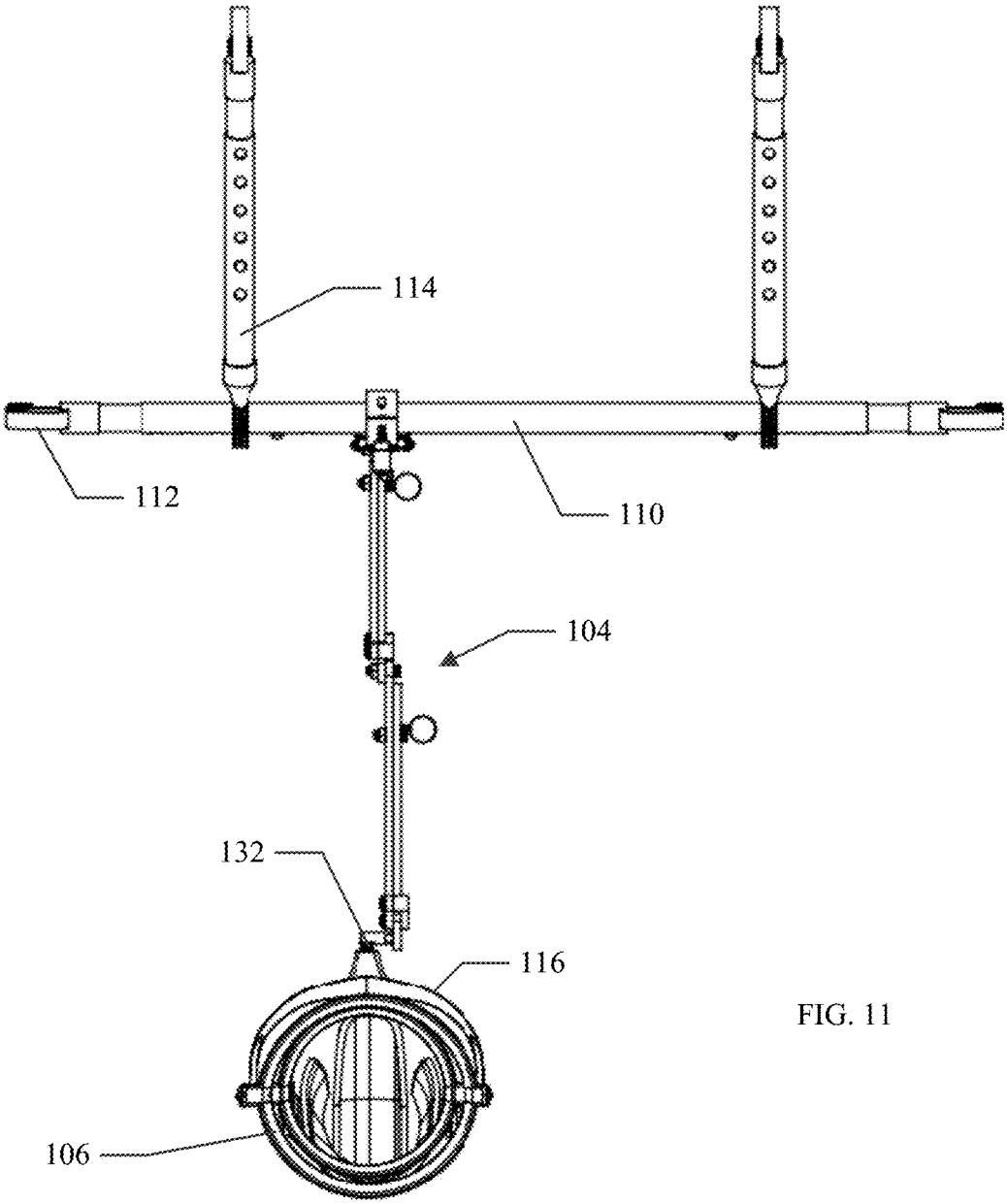
FIG. 11 is a top view of the embodiment of the gait trainer attachment of FIG. 1.
Figure 12:
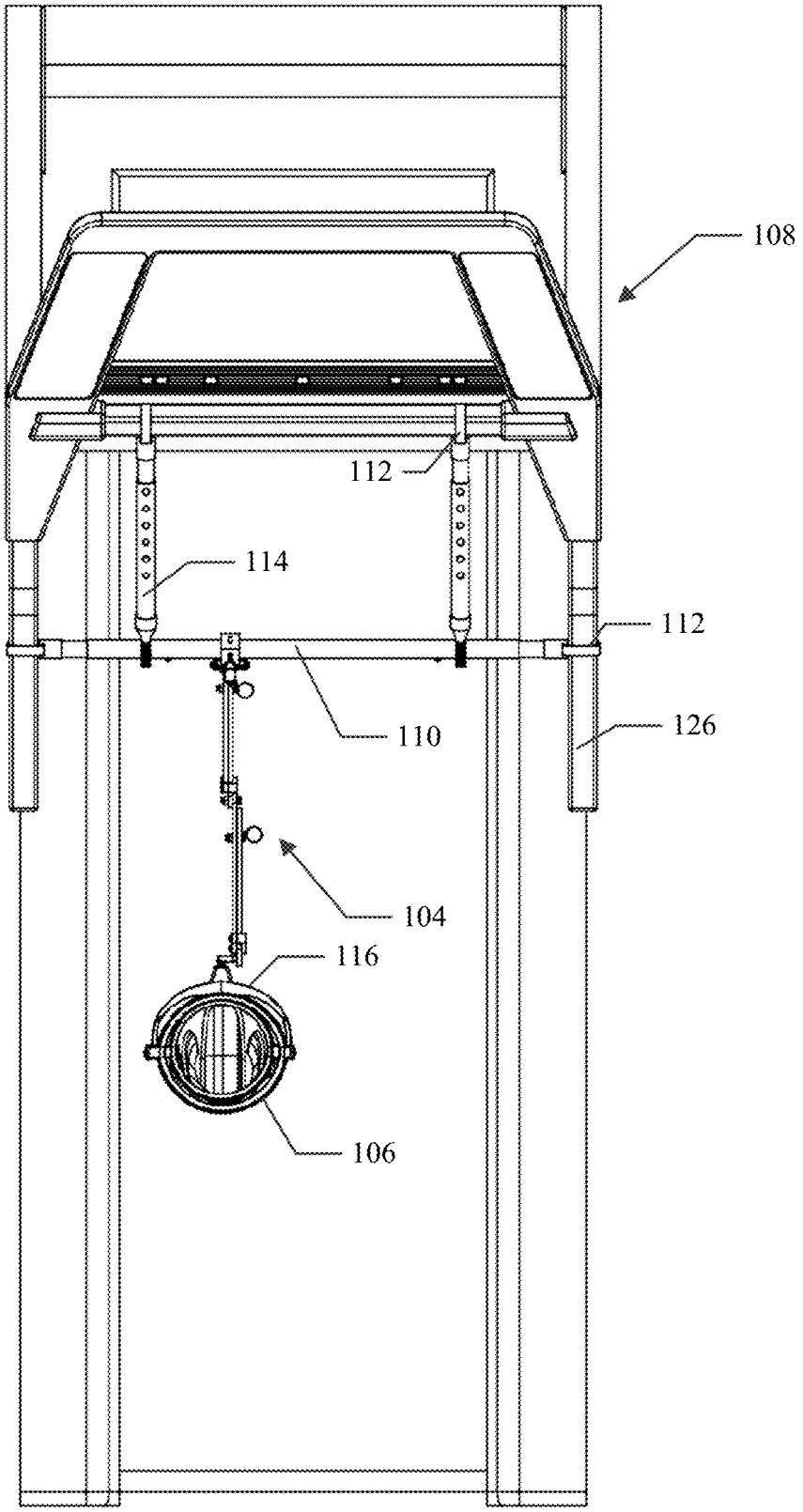
FIG. 12 is a top view of the embodiment of the gait trainer attachment of FIG. 1 attached to a treadmill.

Referring to FIGS. 1-2, in an embodiment, a gait trainer attachment 100 comprises a frame 102, a compromised limb gait system 104, and a leg brace 106. The frame 102 provides the general support or structure for the gait trainer attachment 100, connects the gait trainer attachment to the exercise equipment 108, and can be implemented in a variety of ways. Generally, the frame 102 provides for stable and secure attachment for the compromised limb gait system 104 while not interfering with movement of the user's legs in a typical walking or running motion. The frame 102 can be configured to work with multiple types and brands of exercise equipment. As used herein, the term "exercise equipment" can include conventional exercise equipment, including but not limited to, treadmills, ellipticals, stair steppers and other common exercise machines, as well as rehabilitation equipment, such as more specialized machines for walking and physical therapy. The frame 102 can be formed from a lightweight, but durable material capable of resisting excessive bending or breaking during use. In embodiments, the frame 102 comprises one or more horizontal bars 110 that attach to the exercise equipment 108 using fasteners 112 such as hooks, clamps, or loops thus allowing the gait trainer attachment 100 to be used in combination with the exercise equipment 108. In other embodiments, the frame 102 comprises one or more attachment arms 114 extending forward from a horizontal bar 110, where the attachment arms 114 also attach to the exercise equipment 108 using fasteners 112 such as hooks, clamps, or loops.

In embodiments, the compromised limb gait system 104 guides the patient's compromised limb through a simulated walking or running motion. A leg brace 106, attached to the compromised limb gait system 104 through a yoke 116, is fitted to the patient's compromised limb. In embodiments, the compromised limb gait system 104 comprises the yoke 116, a swing arm 118, a height adjustment mechanism 120, and a frame-gait system connector 122. The compromised limb gait system 104 can restrict or direct motion of the compromised limb to encourage movement of the limb in the proper, biomechanical gait. The gait trainer attachment 100 encourages the patient to shift some of their weight onto the compromised limb during exercise, strengthening the limb and facilitating rehabilitation. At the same time, the gait trainer attachment reduces abduction and adduction of the limb. By encouraging proper gait motion when used with common exercise equipment, the illustrated gait trainer attachment 100 can allow users to train in ways otherwise restricted by the time constraints of ordinary physical therapy sessions and the equipment limitations of ordinary gait trainers. The illustrated gait trainer attachment 100 is particularly well-suited for extended duration endurance training.

Frame

Referring to FIGS. 1-12 and 14, the frame 102 provides for stable and secure attachment for the compromised limb gait system 104 to the exercise equipment 108, while not interfering with movement of the patient's legs in a typical walking or running motion. Naturally, this frame 102 can be implemented in a variety of ways. In embodiments, the frame 102 comprises one or more horizontal bars 110 that attach to the exercise equipment 108 using fasteners 112 such as hooks, clamps, or loops. In other embodiments, the frame 102 comprises a horizontal bar 110, one or more attachment arms 114 that also attach to exercise equipment 108 using fasteners 112 such as hooks clamps, or loops, and one or more frame connectors 124 that attach the attachment arms 114 to the horizontal bar 110. In depicted embodiments, the attachment arms 114 extend perpendicularly forward from the horizontal bar 110. The frame 102 can be made of materials such as aluminum or steel such that the frame 102 is sufficiently strong to support the compromised limb gait system 104 and resist excessive bending or breaking during use. The horizontal bar 110 or attachment arms 114, or both, can attach to grab bars 126 on the exercise equipment 108, here a treadmill. Grab bars 126 are designed to be sturdy and stable for the user to grip and therefore provide the frame 102 and therefore the gait trainer attachment 100 with a solid base. The horizontal bar 110 is designed to attach to the exercise equipment in front of the user's position to allow the user to take normal steps or strides without bumping or impacting the horizontal bar 110. In embodiments, horizontal bar 110 is positioned to hold the compromised limb gait system 104 at the proper height to guide the user's compromised limb.

In the embodiments depicted in FIGS. 1-12 and 14, the attachment arms 114 and horizontal bar 110 can be lengthened or shortened, and the attachment arms 114 are laterally adjustable along the horizontal bar 110 to accommodate different types and designs of exercise equipment. For example, the frame 102 can be implemented using telescopic rods, which can be fixed in position by tightening the perimeter of the external rod around an inner rod. In other embodiments, the telescopic rods can include a series of apertures such the length of the attachment arms 114 and horizontal bar 110 can be fixed by aligning apertures in the external rod and internal rod and inserting a pin into the aperture. It is understood that the horizontal bar 110 and attachment arms 114 need not be rods and can be implemented with any configuration that permits the user to adjust and fix the length of the horizontal bar 110 and attachment arms 114. The frame connectors 124 can be implemented as clamps that slide laterally with respect to the horizontal bar and can be fixed at a desired angle and position. In further embodiments, the frame connectors 124 permit a user to partially disassemble the frame 102 for convenient transport and storage. In other embodiments, any suitable frame connector 124 can be used to attach the compromised limb gait system 104 to the frame 102 either at an adjustable or fixed location.

Compromised Limb Gait System

Figure 13:
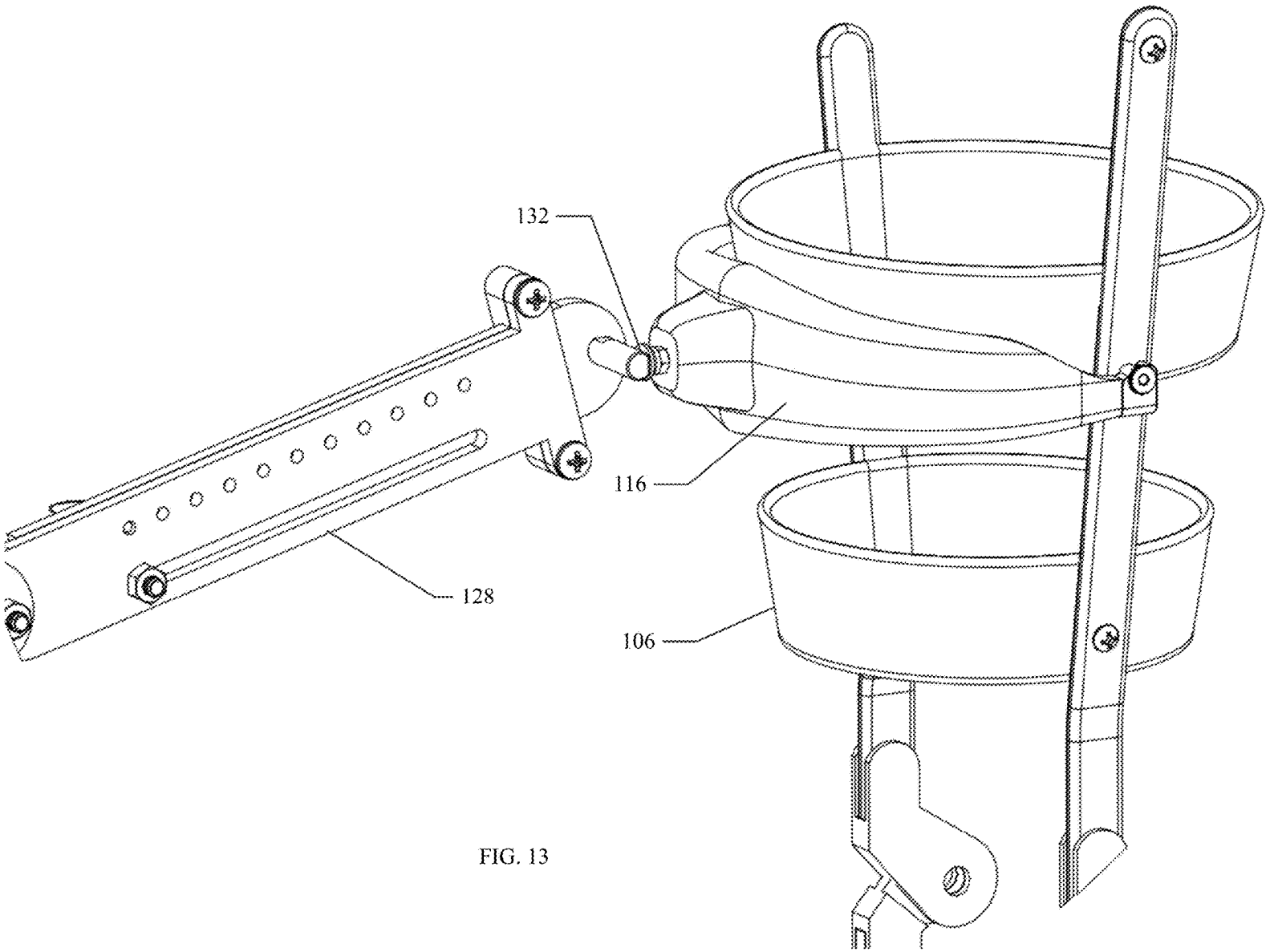
FIG. 13 is a perspective view of embodiments of a swing arm linkage connected to a leg brace of a gait trainer attachment.
Figure 14:
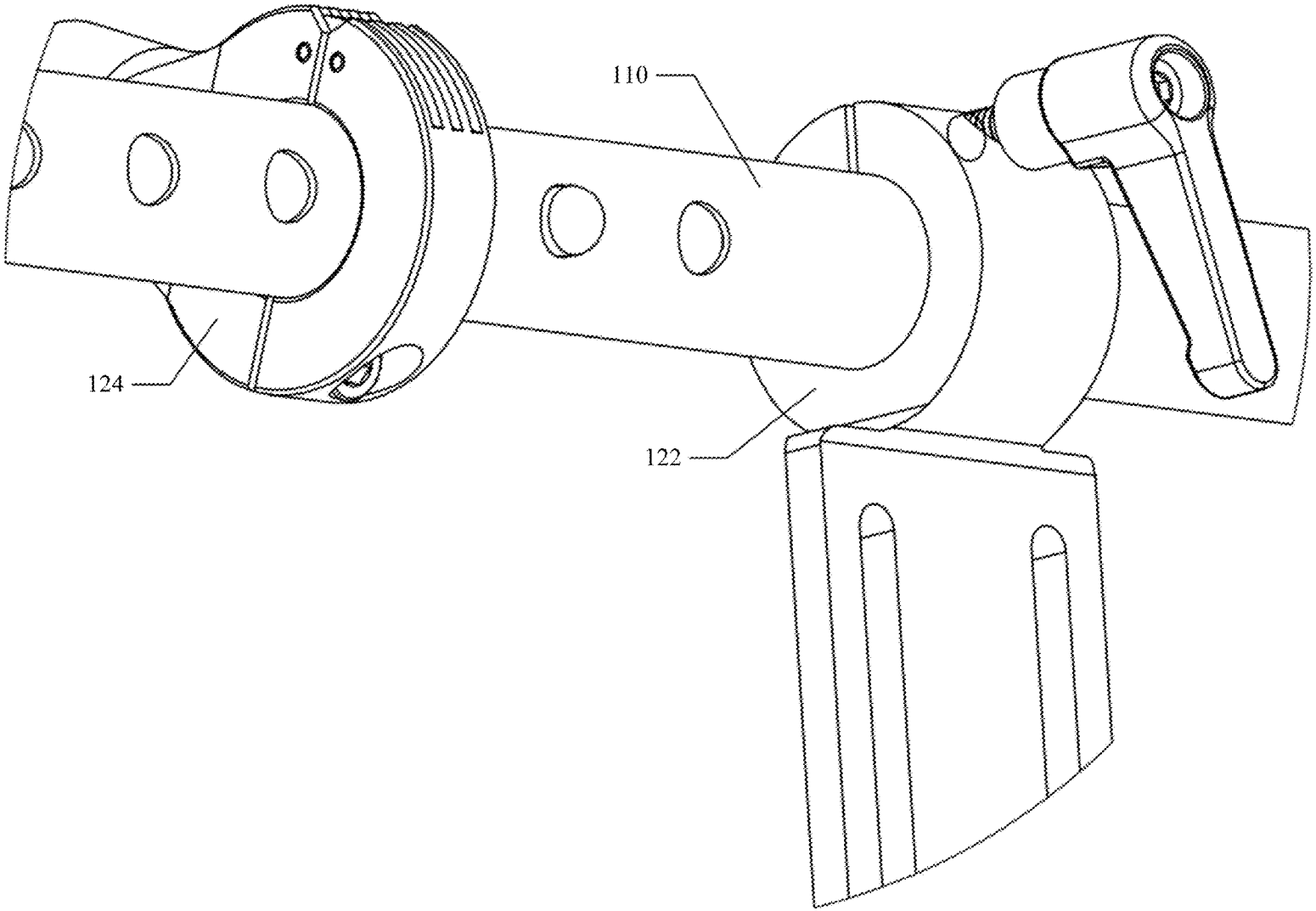
FIG. 14 is a perspective view of embodiments of a frame connector and a frame-gait system connector of a gait trainer attachment.
Figure 15:
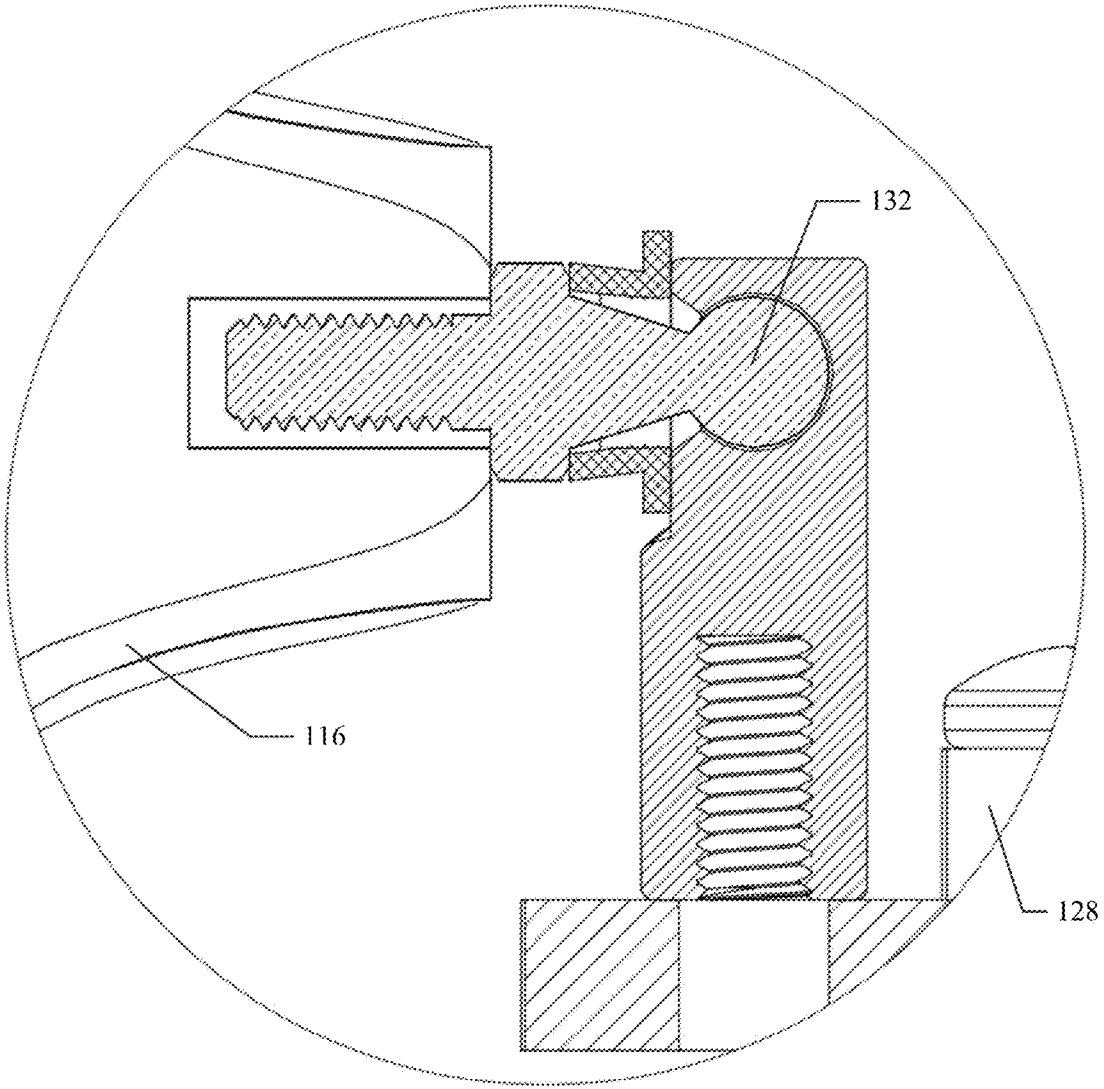
FIG. 15 is a sectional view of an embodiment of a ball joint of a gait trainer attachment.

Referring now to FIGS. 1-17, an embodiment of the compromised limb gait system 104 is shown. In the illustrated embodiment, the compromised limb gait system 104 includes a frame-gait system connector 122 that attaches the compromised limb gait system 104 to the frame 102, a height adjustment mechanism 120, a swing arm 118, a leg brace 106, and a yoke 116 that connects a leg brace 106 to the swing arm 118. As shown in FIG. 13, the frame-gait system connector 122 can be implemented as a clamp that slides laterally with respect to the horizontal bar 110 of the frame 102 and can be fixed at a desired position and angle. This permits the location of the compromised limb gait system 104 to be adjusted laterally relative to the frame 102 and customized for the size and shape of the user. In other embodiments, any suitable frame-gait system connector 122 can be used to attach the compromised limb gait system 104 to the frame 102 either at an adjustable or fixed location. While the illustrated embodiments are shown with a leg brace 106 for a compromised left leg, the frame-gait system connector 122 and compromised limb gait system 104 can be reoriented to support a leg brace 106 for a compromised right leg.

In embodiments, the swing arm 118 comprises one or more swing arm linkages 128 that are connected to the height adjustment mechanism 120 and each other via one or more hinge joints 130. These hinge joints permit substantially planar movement of the swing arm linkages 128, helping to guide the motion of the compromised limb and reducing lateral movement of the limb. In other embodiments, the swing arm 118 is fixed to the height adjustment mechanism 120 or the other types of joints can be used to connect the swing arm 118 to the height adjustment mechanism 120 and the swing arm linkages 128 to each other. The yoke 116 connects the leg brace 106 to the swing arm 118 and in the illustrated embodiment is connected to the swing arm 118 via a ball joint 132, shown in detail in FIGS. 13 and 15. In embodiments, the ball joint 132 limits movement in all directions to 15 degrees of rotation, relative to the swing arm 118. In another embodiment, the ball joint 132 limits rotation to 6 degrees of rotation. Accordingly, the ball joint 132 allows for natural, slight deviation from planar motion of the compromised limb, while still limiting abduction and adduction. In other embodiments, the yoke 116 is connected to the swing arm 118 via a hinge joint which permits substantially planar movement of the yoke 116 relative to the swing arm 118. Frequently, users with compromised limbs adapt their stride to make up for the weakness in the compromised limb, often resulting in increased lateral motion of the limb during the gait. But this change in gait mechanics can injure or stress other muscles or joints. The compromised limb gait system 104 directs the leg brace 106 and compromised limb in the typical, generally longitudinal progress of the limb during walking. The swing arm linkages 128, ball joint 132 and yoke 116 move with both the rotational and longitudinal movement of the limb, but limit lateral movement, approximating the natural gait of the limb.

As shown, in the illustrated embodiment, the yoke 116 connects to each side of the leg brace 106 with a pin joint or revolute joint. This allows the leg brace 106 to rotate freely with respect to the yoke 116, while restricting lateral movement. Connecting proximate to the knee of the user, or below the hip, is particularly advantageous as it allows the rotational mobility of the pin or revolute joint to replace, or work in combination with, the natural rotational mobility of the knee. In addition, by connecting proximate to the knee and below the hip of the user, the gait trainer attachment 100 does not need to be customized to fit the waist or hip dimensions of the user.

In embodiments, the leg brace 106 is detachable so that it can be placed on or fitted to the compromised limb of the user. This allows the user to attach the leg brace 106 in a seated, comfortable position. Once the leg brace 106 is fitted to the limb, the leg brace 106 can be attached to the compromised limb gait system 104 via the pin joints and move in a natural manner. The yoke 116 and swing arm linkages 128 control movement of the leg brace 106 and compromised limb facilitating normal gait mechanics and encouraging proper walking motion.

Figures 16, 17:
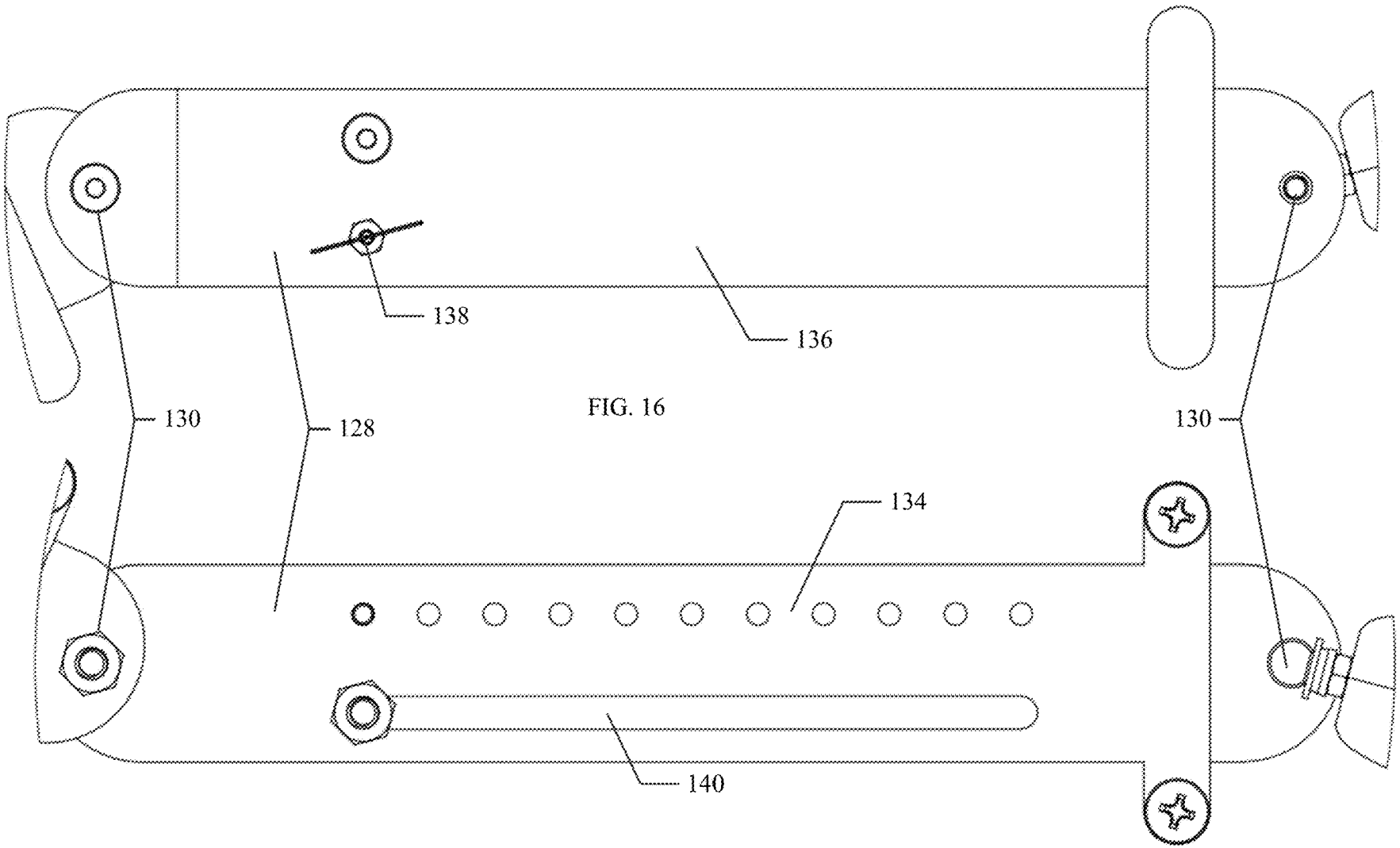
FIG. 16 is a right side view of an embodiment of a swing arm linkage of a gait trainer attachment.
FIG. 17 is a left side view of the embodiment of the swing arm linkage of FIG. 16.

In embodiments, as depicted in FIGS. 16 and 17, the swing arm linkages 128 can be individually lengthened or shortened. For example, the swing arm linkages 128 can be implemented using telescopic plates, which can be fixed in position by aligning one of several apertures on a first plate 134 with a single aperture on a second plate 136 and inserting a screw 138. In embodiments, a guide channel mechanism 140 aligns the telescoping plates during adjustment. In other embodiments, the swing arm linkages 128 can be implemented using telescoping rods, which can be fixed in position by tightening the perimeter of the external rod around an inner rod, or by aligning apertures in the external rod and internal rod and inserting a pin into the aperture. In yet other embodiments, the swing arm linkages 128 can be implemented with any configuration that permits the user to adjust and fix the length of the swing arm linkages 128. The height adjustment mechanism 120 allows the compromised limb gait system to be raised or lowered relative to the exercise equipment 108 and can be implemented using telescoping plates, rods, or any configuration that permits the user to adjust and fix the length of the height adjustment mechanism 120.

The length of the swing arm linkages 128 and height of the compromised limb gait system 104 can be customized for the stride of the user and can be used to prevent drag of the compromised limb. The length of the swing arm linkages can limit the rearward motion of the swing arm 118, which prevents the swing arm 118, and therefore the compromised limb, from extending too far to the rear of the gait trainer attachment 100. This encourages the patient to stride with the compromised limb and discourages dragging of the limb. By stopping the rearward motion of the swing arm 118, the length of the swing arm 118 communicates to the patient when the simulated gait motion has been completed for a particular step and when it is time to begin another step and continue the simulated gait motion. In another embodiment, the swing arm linkage 128 can include a hard stop implemented as a simple bar that limits the rotation of the swing arm 118 relative to the height adjustment mechanism 120, thereby limiting the rearward motion of the swing arm 118.

Figure 18A:
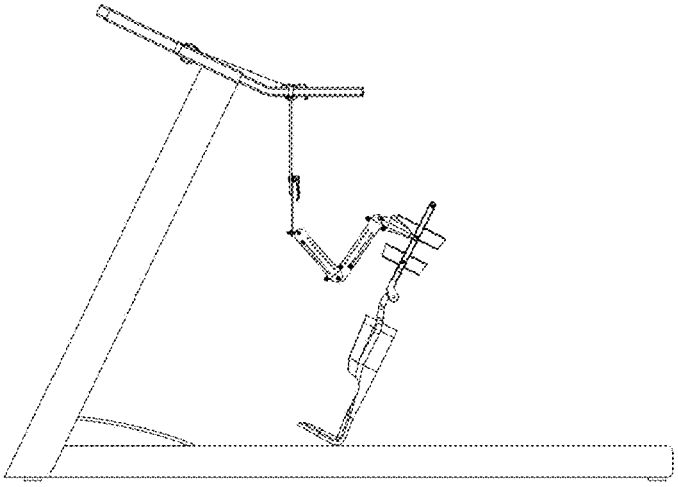
FIG. 18A is a left side view of an embodiment of the gait trainer attachment, where the brace is in a heel strike position.
Figure 18B:
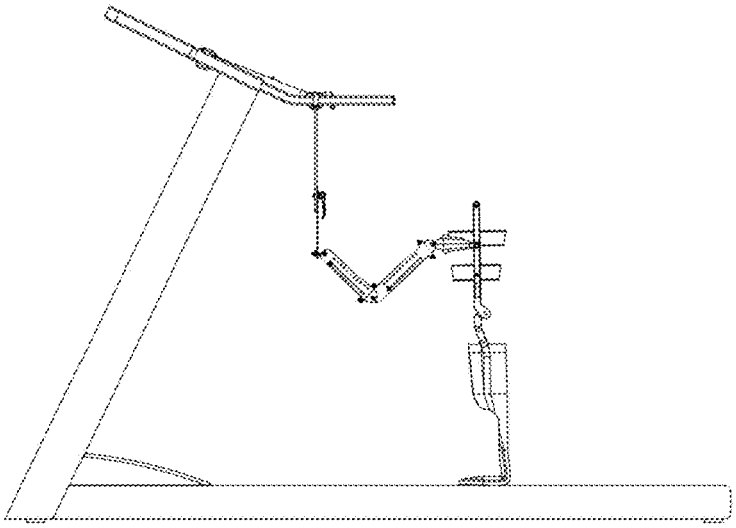
FIG. 18B is a left side view of an embodiment of the gait trainer attachment, where the brace is in a mid-stride position.
Figure 18C:
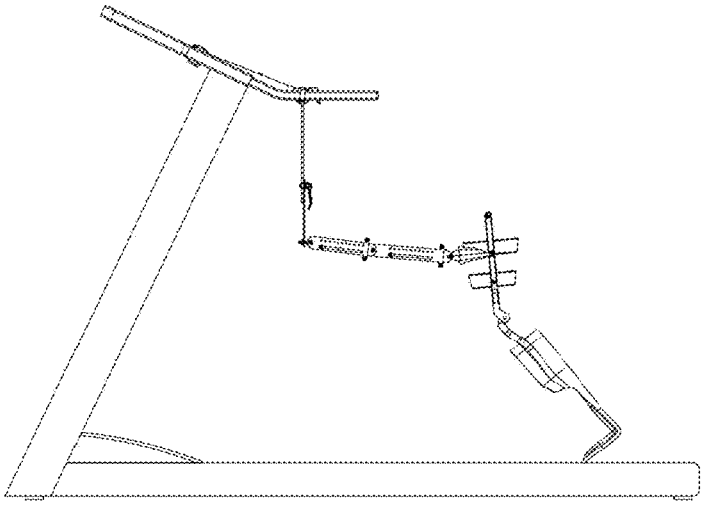
FIG. 18C is a left side view of an embodiment of the gait trainer attachment, where the brace is in a toe off position.

Referring to FIGS. 18A-18C, the swing arm 118, connected to the leg brace 106 via the yoke 116, guides the movement of the compromised limb in a normal walking or running motion during use. When the patient takes a step using the compromised limb the patient rotates the limb forward, kicking out the leg brace 106 in the same manner as a patient would if wearing a prosthetic limb, as illustrated in FIG. 18A. The swing arm linkages 128 of the compromised limb gait system 104 form an initial angle and the leg brace 106 rotates relative to the yoke 116. When the patient steps forward and places weight on the limb, the compromised limb in the leg brace 106 is nearly vertical, as illustrated in FIG. 18B. The swing arm linkages 128 of the compromised limb gait system 104 form an angle greater than the initial angle and the leg brace 106 rotates until it is approximately perpendicular to the yoke 116. As the user transfers weight off the compromised limb, raising the limb, the swing arm linkages 128 of the compromised limb gait system 104 form a straight line and stop the rearward motion of the swing arm 118 or a hard stop stops the rearward motion of the swing arm 118. This indicates to the user that it is time to begin the next step in the simulated gait motion. As the user continues to walk, the user kicks the leg brace 106 and compromised limb out again, as illustrated in FIG. 18C, and repeats the cycle. This guides the compromised limb to move in a manner that approximates a normal walking motion and that achieves the angle mechanics of a healthy gait cycle. The swing arm 118 and yoke 116 limit lateral motion, encouraging compromised limb to move in a natural manner.

Leg Brace

Referring now to FIGS. 1-13 and 18, the leg brace 106 is designed to receive the compromised limb of the patient. In embodiments, the leg brace 106 can be customized to snugly receive the compromised limb of patients of different shapes and sizes. In embodiments, when the gait trainer attachment 100 is in use, the upper end of the leg brace 106 is attached the patient's upper thigh, and in the case of an amputee, the lower end of the leg brace 106 extends beyond the end of the compromised limb. Attaching the leg brace 106 above the amputation protects the wound caused by the amputation from experiencing pressure. However, in an alternative embodiment, the leg brace 106 could attach lower on the compromised limb or extend over a greater surface area of the limb. For example, in the case of a patient with a below the knee amputation, the customized leg brace 106 could be designed to support the compromised limb below the knee, attaching either above or below the knee joint. In embodiments, the leg brace 106 may be detached from the gait trainer attachment 100 to allow the patient to attach the leg brace 106 on his or her compromised limb before approaching the exercise equipment 108. The leg brace 106 can be made from a sturdy yet flexible material to minimize the chance of pressure sores on the compromised limb.

Figure 19:
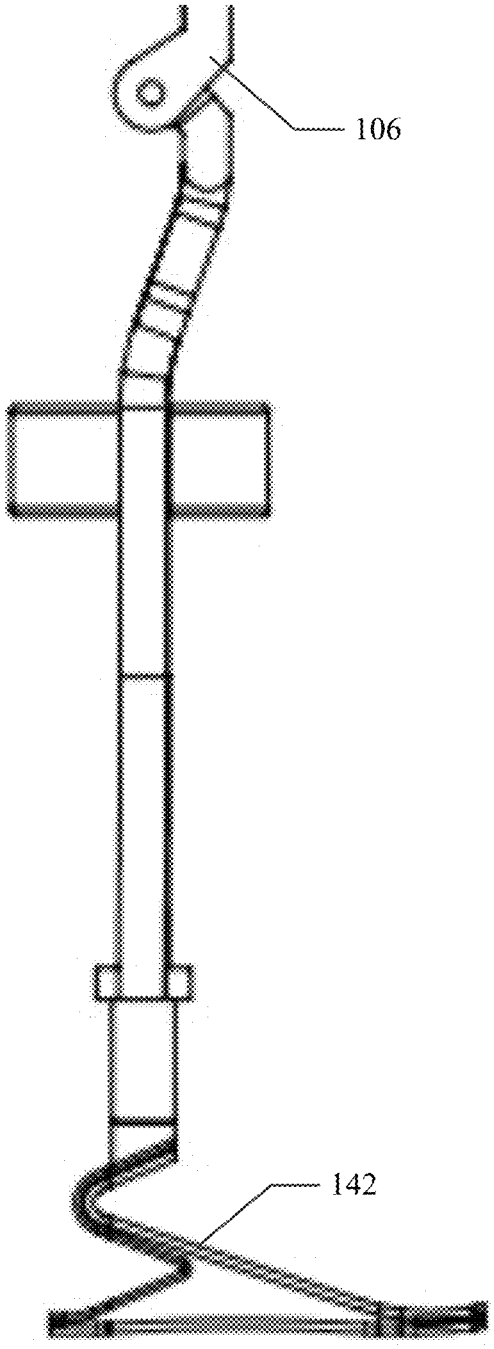
FIG. 19 is a right side view of an embodiment of a pseudo-foot of a gait trainer attachment.

Referring to FIG. 19, in embodiments, a pseudo-foot 142 is attached at the bottom of the leg brace 106, and is capable of mimicking the movement of the eventual prosthetic limb and/or supporting the leg brace 106 and compromised limb. The pseudo-foot 142 moves in the same manner as a prosthetic limb, allowing the patient to practice placement of the foot while using the gait trainer attachment 100. In further embodiments, the leg brace 106 includes a passive knee joint having a hinge that allows the pseudo-foot 142 to swing freely from the bottom of the leg brace 106. When using the device, the patient's muscles will exert force so that the pseudo-foot 142 will make contact with the ground at times corresponding with a natural walking motion, thus allowing the patient to simulate a natural gait motion and activate the muscles utilized during a natural gait motion.

In depicted embodiments, in the case of a patient that is monoplegic or has reduced function in their compromised limb, but is not an amputee, the leg brace 106 can be attached to the compromised limb and can extend from the thigh to the foot of the patient or any portion thereof. In this embodiment, the leg brace 106 can either support and direct movement of the knee or ankle joints or fix those joints in place. In FIGS. 1-12 and 18, the leg brace 106 is for a patient with a full leg and wraps behind the patient's calf and under the foot.

Methods of Use

In an embodiment, to use the gait trainer attachment 100, the patient first attaches the frame 102 with the connected compromised limb gait system 104 to compatible exercise equipment 108, for example, a treadmill. In preparation to attach the frame 102 to the exercise equipment 108, the user first lengthens or shortens the horizontal bar(s) 110 for the exercise equipment 108. Next, the user secures the horizontal bar 110 to the grab bars 126 or comparable side components of the exercise equipment 108. In other embodiments, the user would also lengthen or shorten the attachment arms 114 and secure the attachment arms 114 to the front portion of the exercise equipment 108. Then, the user fixes the compromised limb gait system 104 to the frame 102 at the desired position using the frame-gait system connector 122 and adjusts the height of the compromised limb gait system 104 using the height adjustment mechanism 120. Once the gait trainer attachment 100 is secured to the exercise equipment 108 and the height set, the user attaches the leg brace 106 to the compromised limb. In other embodiments, the user could detach the leg brace 106, attach the leg brace 106 to the compromised limb, then reattach the leg brace 106 to the yoke 116. Beginning his or her first stride, the user begins the kicking motion on the side of the compromised limb and progresses forward through the force on the solid limb. While the user activates his or her own muscles, the compromised limb gait system 104 will permit the compromised limb to move in an approximation of their normal gait motion. This enables the leg to move through the proper biomechanics of walking or running and allows the force of the compromised limb to be absorbed through the thigh and hip. Some embodiments, for example use with a treadmill, may require the user to begin his or her first stride while simultaneously initiating motion of the exercise equipment 108. While the steps of use are described in a particular order, variations in order of the steps are contemplated.

What has been described above includes examples of aspects of the claimed subject matter. It is, of course, not possible to describe every conceivable combination of components or methodologies for purposes of describing the claimed subject matter, but one of ordinary skill in the art may recognize that many further combinations and permutations of the disclosed subject matter are possible. Accordingly, the disclosed subject matter is intended to embrace all such alterations, modifications and variations that fall within the spirit and scope of the appended claims. Furthermore, to the extent that the terms "includes," "has" or "having" or variations in form thereof are used in either the detailed description or the claims, such terms are intended to be inclusive in a manner similar to the term "comprising" as "comprising" is interpreted when employed as a transitional word in a claim.

What is claimed is:

1. A gait trainer attachment adapted for use with an exercise equipment, comprising:
- an adjustable frame that removably attaches to the exercise equipment, wherein the adjustable frame comprises:
  - one or more horizontal bars configured to attach to grab bars of the exercise equipment; and
  - one or more attachment arms extending forward from the one or more horizontal bars, where the one or more attachment arms are configured to attach to a front portion of the exercise equipment,
  - wherein the one or more horizontal bars and the one or more attachment arms are adjustable in length;
- a leg brace configured to hold a compromised limb of a user; and
- a compromised limb gait system connecting the leg brace to the adjustable frame and configured to guide the compromised limb through a simulated gait motion.

2. The gait trainer attachment of claim 1, wherein the compromised limb gait system comprises:
- a swing arm connected to the adjustable frame; and
- a yoke that connects the leg brace to the swing arm.

3. The gait trainer attachment of claim 2, wherein the swing arm comprises one or more swing arm linkages connected by one or more hinge joints.

4. The gait trainer attachment of claim 1, wherein the adjustable frame further comprises one or more fasteners, connected proximate to ends of the one or more horizontal bar and the one or more attachment arms, where the one or more fasteners are configured to attach the exercise equipment.

5. The gait trainer attachment of claim 1, wherein the exercise equipment comprises a treadmill.

6. The gait trainer attachment of claim 1, wherein the leg brace further comprises a pseudo-foot protruding from the leg brace that mimics a natural gait motion of a foot.

7. A gait trainer attachment adapted for use with an exercise equipment, comprising:
- an adjustable frame that removably attaches to the exercise equipment;
- a leg brace configured to hold a compromised limb of a user; and
- a compromised limb gait system connecting the leg brace to the adjustable frame and configured to guide the compromised limb through a simulated gait motion, wherein the compromised limb gait system comprises:
  - a swing arm connected to the adjustable frame, wherein the swing arm permits movement in a single plane a yoke that connects the leg brace to the swing arm, wherein the yoke is connected to the swing arm by a ball joint;

wherein the compromised limb gait system further comprises:

a height adjustment mechanism connected to the swing arm and configured to allow the compromised limb gait system to be raised or lowered relative to the frame;

a frame-gait system connector connecting the height adjustment mechanism to the frame and configured to allow the compromised limb gait system to be adjusted laterally relative to the frame.

8. The gait trainer attachment of claim 7, wherein the leg brace is configured to conform to the compromised limb of the user and wrap around a circumference of the compromised limb of the user to avoid putting pressure on a surgical site on the compromised limb of the user.

9. The gait trainer attachment of claim 8, wherein the leg brace further comprises a pseudo-foot protruding from the leg brace that mimics a natural gait motion of a foot.

10. The gait trainer attachment of claim 7, wherein the ball joint restricts movement to fewer than fifteen degrees in all planes.

11. The gait trainer attachment of claim 7, wherein the exercise equipment comprises a treadmill.

12. The gait trainer attachment of claim 7, wherein the ball joint permits limited omnidirectional movement of the leg brace relative to the swing arm.

13. A gait trainer attachment adapted for use with an exercise equipment, comprising:

an adjustable frame that removably attaches to the exercise equipment;

a leg brace configured to hold a compromised limb of a user; and a compromised limb gait system connecting the leg brace to the adjustable frame and configured to guide the compromised limb through a simulated gait motion, wherein the compromised limb gait system comprises:

a swing arm connected to the adjustable frame, wherein the swing arm comprises one or more swing arm linkages connected by one or more hinge joints, wherein the swing arm linkages are adjustable in length, wherein the swing arm permits movement in a single plane;

a yoke that connects the leg brace to the swing arm.

14. The gait trainer attachment of claim 13, wherein the yoke is connected to the swing arm by a hinge joint.

15. The gait trainer attachment of claim 13, wherein the exercise equipment comprises a treadmill.

16. The gait trainer attachment of claim 13, wherein the leg brace further comprises a pseudo-foot protruding from the leg brace that mimics a natural gait motion of a foot.

* * * * *